US012422218B2

(12) United States Patent
Kretsinger

(10) Patent No.: US 12,422,218 B2
(45) Date of Patent: Sep. 23, 2025

(54) ON-BOARD AND HOLSTER SIDE FIREARM RETENTION

(71) Applicant: Shane Allan Kretsinger, Grantsburg, WI (US)

(72) Inventor: Shane Allan Kretsinger, Grantsburg, WI (US)

( * ) Notice: Subject to any disclaimer, the term of this patent is extended or adjusted under 35 U.S.C. 154(b) by 272 days.

(21) Appl. No.: 18/142,361

(22) Filed: May 2, 2023

(65) Prior Publication Data

US 2024/0142196 A1 May 2, 2024

Related U.S. Application Data

(60) Provisional application No. 63/437,765, filed on Jan. 9, 2023, provisional application No. 63/421,412, filed on Nov. 1, 2022.

(51) Int. Cl.
*F41C 33/02* (2006.01)

(52) U.S. Cl.
CPC ..... *F41C 33/0245* (2013.01); *F41C 33/0263* (2013.01)

(58) Field of Classification Search
CPC .. F41C 33/0245; F41C 33/04; F41C 33/0236; F41C 27/00; F41A 17/54; F41A 19/09; F41A 19/11; F41A 19/10
See application file for complete search history.

(56) References Cited

U.S. PATENT DOCUMENTS

| | | | | |
|---|---|---|---|---|
| 3,669,325 | A * | 6/1972 | Furman | F41C 33/0263 42/106 |
| 5,515,633 | A * | 5/1996 | Harris | F41A 17/54 42/70.07 |
| 6,474,238 | B1 * | 11/2002 | Weinraub | F41A 17/54 42/70.07 |
| 8,434,253 | B2 * | 5/2013 | Cain | F41A 17/38 42/6 |
| 10,520,270 | B2 * | 12/2019 | Bair | F41A 19/09 |
| 11,499,799 | B2 * | 11/2022 | Self | F41C 33/0245 |
| 2018/0335267 | A1 * | 11/2018 | Kiyani | F41A 17/063 |

* cited by examiner

*Primary Examiner* — Corey N Skurdal
(74) *Attorney, Agent, or Firm* — Westman, Champlin & Koehler, P.A.; Amanda M. Prose

(57) ABSTRACT

A retention device for a firearm includes a latching lever mountable to a trigger guard of the firearm, and a latching receiver configured to receive and retain the firearm. The latching lever is pivotable about a first pivot point between a first engaging position and a second release position. The latching receiver is configured to receive and retain the firearm, and includes a latch pivotable about a second pivot point between a firearm engaging position and a firearm release position. The latch has a protrusion configured to engage and retain the firearm when the latching lever is in the first engaging position.

19 Claims, 13 Drawing Sheets

ON-BOARD AND HOLSTER SIDE FIREARM RETENTION

BACKGROUND

Belt type holsters for handguns are known to have been in use since at least the 1840s. While early holsters were little more than an open pocket that provided a gun carrying location outside the operators clothing, modern holsters have improved substantially since the earliest specimens.

Recently, gun to holster retention devices that physically lock the gun into the holster have become sought after with operators ranging from military, to law enforcement officers, to every day civilians alike recognizing the benefits of having a holster that is equipped to keep the gun from accidentally falling out of the holster while the operator is in motion, or from being easily taken from the holster by others when the operators attention is otherwise distracted.

Many military and law enforcement agencies have increased requirements for duty holsters in use by their members. These applications often require enhanced levels of gun to holster retention that meet a specified criteria set forth by the governing members in order to meet safety standards that have been adopted.

Existing gun to holster retention has historically been provided by a mechanical device that includes a blocking device such as a strap affixed with a snap, a tie down lanyard, or similar safety bale designed to keep the gun inside the holster.

Many military and law enforcement agencies are now requiring multiple firearm to holster retention devices to create a redundancy of retention, and automatic locking capability to provide higher levels of safety than was ever before possible.

The retention devices that are currently available are designed to engage with features that are common on the gun such as the trigger guard or the ejection port.

Retention devices that work in this manner result in a release mechanism that often requires unnatural positioning, or an additional movement of the operators hand in order to release the retention device allowing the gun to be removed from the holster.

Due to the need for operators to be able to quickly, reliably, and easily remove the gun from the holster in the event of a high stress situation without searching for a release mechanism that is neither ergonomically correct, nor intuitively placed, a more adaptive and well-placed retention device is wanted.

SUMMARY

In one embodiment, a retention device for a firearm includes a latching lever mountable to a trigger guard of the firearm, and a latching receiver configured to receive and retain the firearm. The latching lever is pivotable about a first pivot point between a first engaging position and a second release position. The latching receiver is configured to receive and retain the firearm, and includes a latch pivotable about a second pivot point between a firearm engaging position and a firearm release position. The latch has a protrusion configured to engage and retain the firearm when the latching lever is in the first engaging position.

In another embodiment, a firearm receiver includes a latching receiver configured to receive and retain the firearm. The latching receiver includes a latch pivotable about a latch pivot point between a firearm engaging position and a firearm release position. The latch has a protrusion configured to engage and retain the firearm when the latching lever is in the first engaging position.

In another embodiment, a retention device for a firearm includes a latching lever mountable in a groove in a trigger guard of the firearm, and a pin coupling the latching lever to the trigger guard at the first pivot point. The latching lever is pivotable about a first pivot point between a first engaging position and a second release position.

In another embodiment, a jig for modifying a trigger guard of a firearm includes a first jig portion and a second jig portion configured to be joined together for encompassing at least a portion of the trigger guard. A drill opening extends through each of the first jig portion and the second jig portion. The drill opening is configured to engage the trigger guard at a lower portion thereof for drilling an opening in the lower portion from side to side of the trigger guard when the jig is secured on the trigger guard. A groove opening at a bottom of the jig is configured to expose a portion of a bottom of the trigger guard for routing of the bottom of the trigger guard.

In another embodiment, a method of securing a firearm to a receiver includes providing a latching lever mountable to a trigger guard of the firearm, providing a latching receiver configured to receive and retain the firearm, and latching the firearm to the latching receiver. The latching lever is pivotable about a first pivot point between a first engaging position and a second release position. The latching receiver is configured to receive and retain the firearm. The latching receiver includes a latch pivotable about a second pivot point between a firearm engaging position and a firearm release position. The latch has a protrusion configured to engage and retain the firearm when the latching lever is in the first engaging position.

In another embodiment, a method of adding a retention device to a firearm includes mounting a latching lever to a trigger guard of the firearm, and providing a latching receiver configured to receive and retain the firearm. The latching receiver includes a latch pivotable about a latch pivot point between a firearm engaging position and a firearm release position. The latch has a protrusion configured to engage and retain the trigger guard when the latching lever is in the first engaging position.

In another embodiment, a method for modifying a firearm trigger guard to add a retention mechanism includes applying a jig to the trigger guard, drilling a hole in the trigger guard through the drill opening, routing a slot in a bottom of the trigger guard at the groove opening, and inserting a latching lever into the trigger guard by inserting a pin through the hole in the trigger guard and a hole in the latching lever, the latching lever configured to be pivotable between a first engaging position and a second release position.

This summary is not intended to describe each disclosed embodiment or every implementation of on-board and/or holster side retention devices for firearms as described herein. Many other novel advantages, features, and relationships will become apparent as this description proceeds. The figures and the description that follow more particularly exemplify illustrative embodiments.

DETAILED DESCRIPTION OF ILLUSTRATIVE EMBODIMENTS

Figure 1:
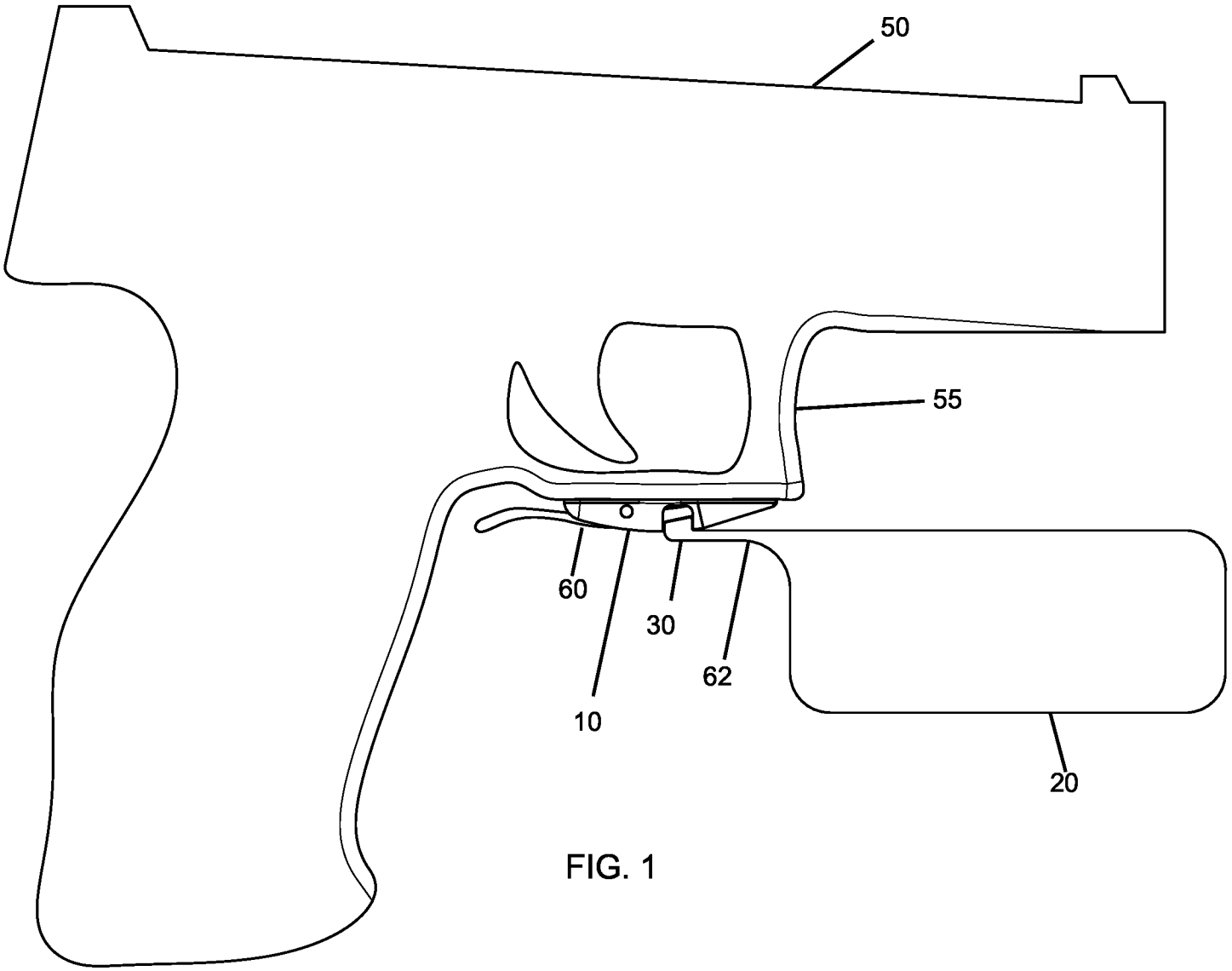
FIG. 1 is a front view showing the firearm with on-board pistol retention device assembly and flexible male capture interface for holster as mounted therein.
Figure 2:
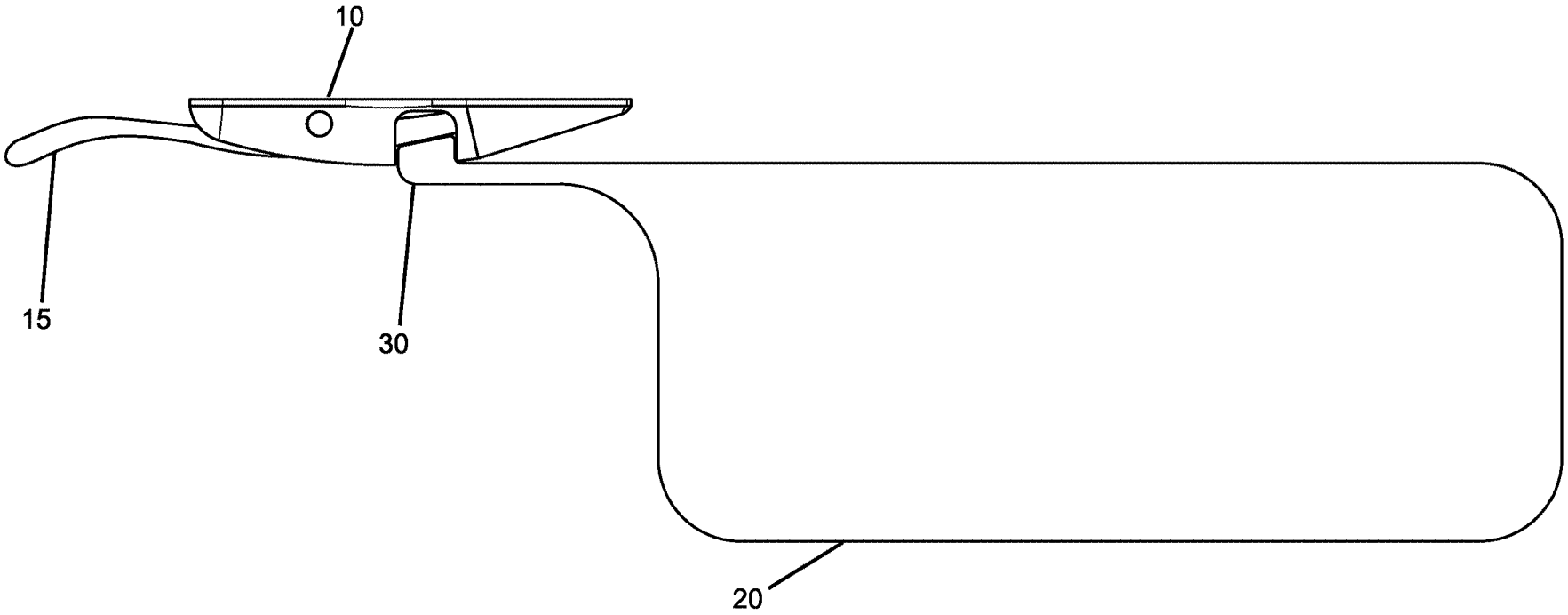
FIG. 2 is a front view thereof with firearm not shown.
Figure 3D:
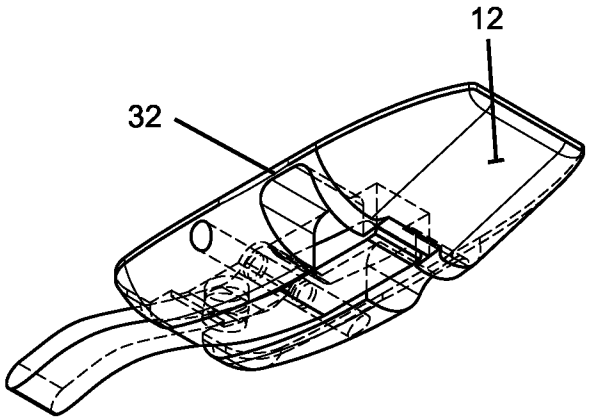
FIG. 3D is a perspective view of the device and internal components illustrated in FIG. 3A.
Figure 3A:
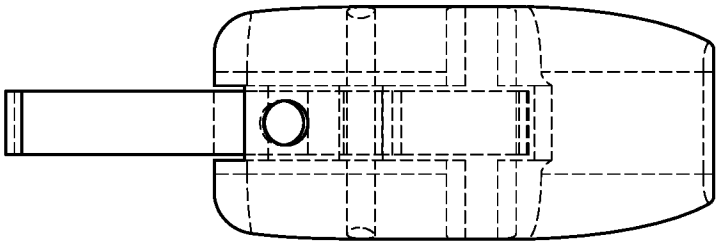
FIG. 3A is a top view of a receiver plate of the on-board pistol retention device assembly.
Figure 3B:
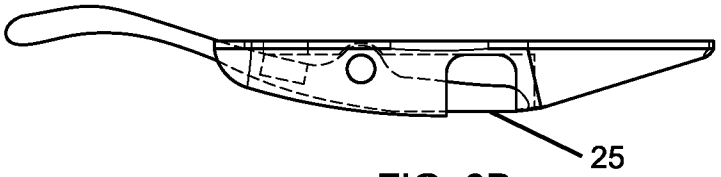
FIG. 3B is a front view showing the firearm holder assembly and expelling mechanism lever as mounted therein.
Figure 3C:
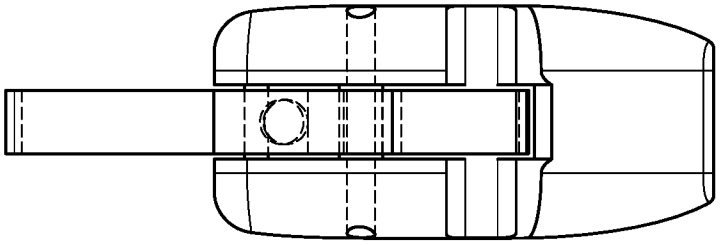
FIG. 3C is a bottom view of the device illustrated in FIG. 3A.
Figure 4:
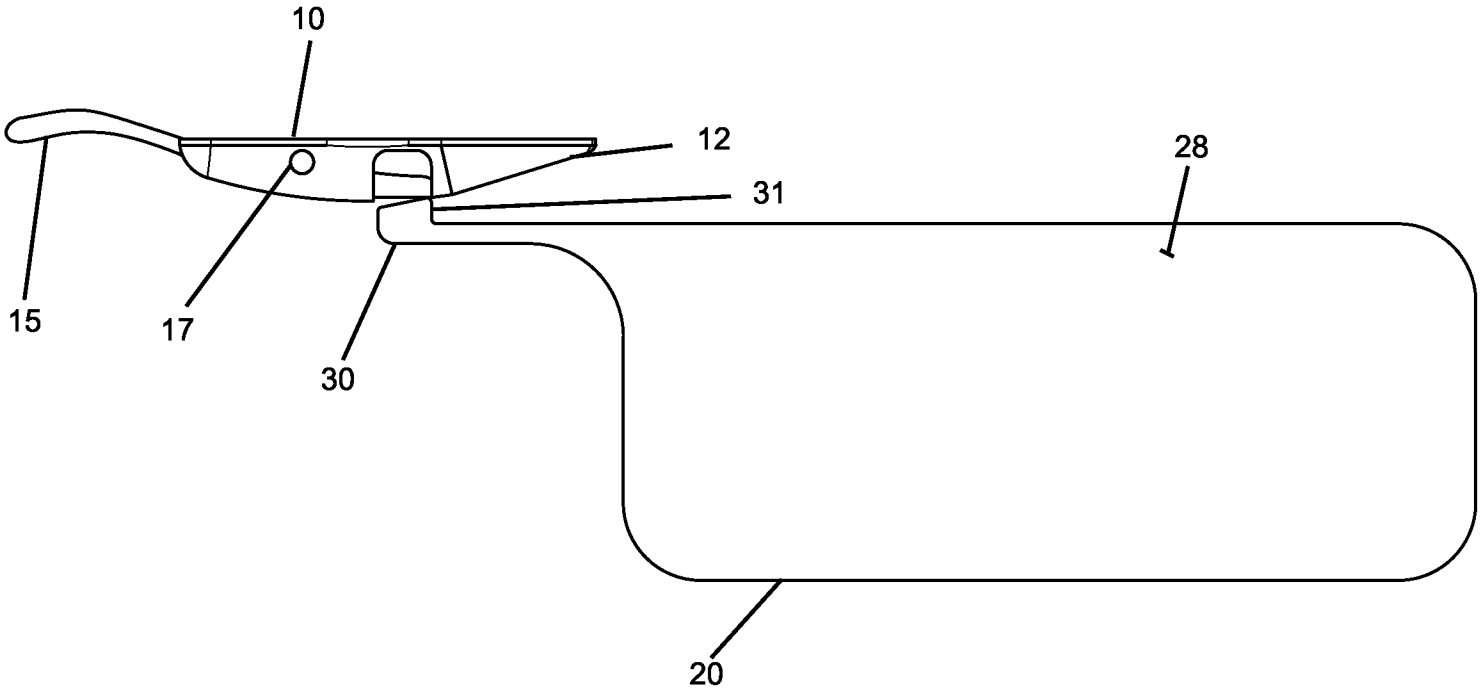
FIG. 4 is a front view of the device illustrated in FIG. 2 in the un-latched condition with the flexible male capture interface expelled.
Figure 5:
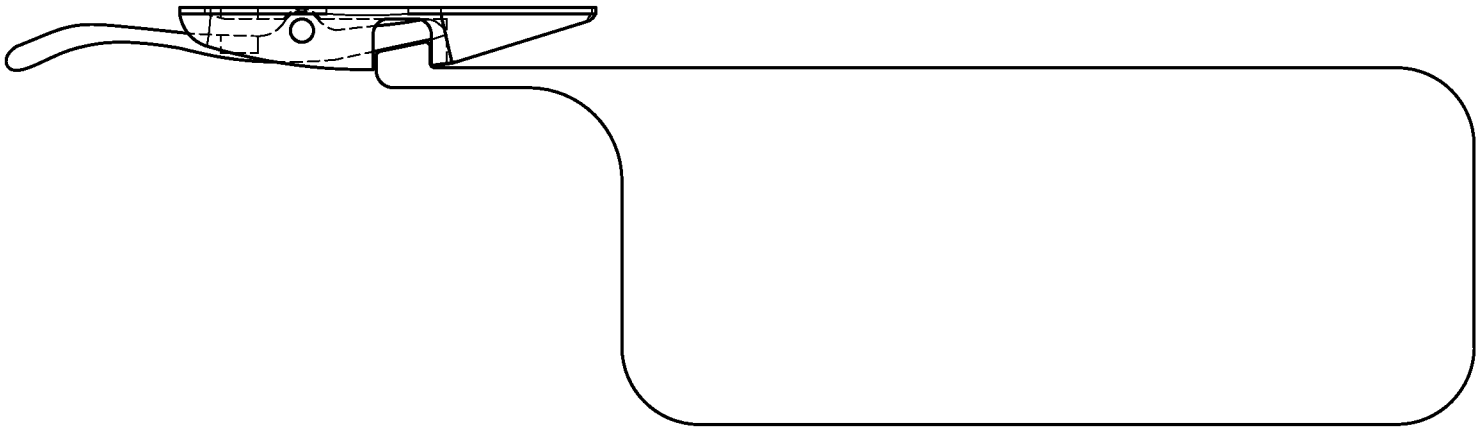
FIG. 5 is a front view of the device illustrated in FIG. 2 in the latched condition with the flexible male capture interface NOT expelled.

In general, embodiments of the present disclosure provide a retention device and method of releasably securing a firearm in a holster or other carrier. The embodiments of the disclosure.

The device described herein provides a gun 50 mounted retention device capable of engaging and grasping or retaining guns 50 within a holster or similar accessory device. The device may be an assembly comprising a receiver plate 10 with a lever expelling mechanism latch device 15 which is able to be manipulated by the operator to accept or manually disengage a male insertion counterpart(s) 20 and the male latching tooth or teeth 31 thereon which may be mounted on a gun 50 holster allowing the gun to be removed from the holster.

Attachment of the receiver plate 10 to the gun 50, either by permanent or removable methods, allows for the direct latching or locking in place of the gun within a holster by utilizing attachment equipment 20 designed to be mounted to the adjacent substrate of a holster. This device effectively places the release mechanism of a holster retention device directly on the gun in a more natural location than other available retention devices making the ergonomics of releasing the gun 50 from the holster easier, more natural, and more reliable.

The receiver plate 10 comprises one or more female receivers 32 that allow for the insertion of latching teeth 31 which are a male counterpart to the female receiver 32. These teeth 31 are configured to cooperate with a female receiver capture device 32 which removably affixes the latching teeth 31, and the holster they are attached to, to the receiver plate 10 until manually expelled by the lever expelling mechanism latch device 15.

The male latching tooth or teeth 31 may be directly mounted to the holster mechanically, or attached with the use of adapter plates, or similar devices 28 to fix the latching tooth or teeth 31 directly to the holster or holster accessories. The latching tooth or teeth 31 may also be a component of the holster itself or a modified version of a holster component such as a "holster screw" that is already found within the design of the holster.

A firearm receiver plate assembly 10 is illustrated in the figures and comprises a receiver plate 10 with a female receiver aperture 32 and the assembly 60 having a ramped surface 12 for guiding a male insertion counterpart and the latching tooth or teeth 31 into the female receiver aperture 32 thereon.

In use, the assembly 60 is secured to a gun 50 by way of a fixed or a removable attachment with fasteners, dovetail or similar geometry, or adhesives. The assembly 60 and/or specific attachment geometry for the same may be machined, molded, or otherwise specifically included in the features of the gun at the time of manufacture.

Embodiments of the assembly 60 are illustrated in FIGS. 1-5. In further detail, the receiver plate body 10 supports one or more ramp features 12 which are configured to guide latching tooth or teeth 31 of a male insertion counterpart 32 into a corresponding female receiver latching aperture 32 on the receiving plate 10 when inserting the gun into the holster and which cooperates with a lever expelling mechanism latch device 15 to eject or expel the latching tooth or teeth 31 of the male insertion counterpart 32 from the female receiver aperture 32 allowing the gun to be removed from the holster.

The receiver plate body 10 may have one or more apertures for insertion of a pivot pin or roll pin 17 to allow appropriate movement and intended functionality of the of the lever expelling mechanism latch device 15.

Referring to FIGS. 1-5, for example, the male insertion counterpart 32 may further support one or more areas of flexure 62, where engagement and/or disengagement of the latching tooth or teeth 31 with the hitch latching apertures 32 may be driven by spring tensioning.

Described herein is device to secure a firearm in a holster. The device is secured to or within the firearm holster and comprises a latching mechanism which automatically locks the firearm in the holster when the firearm is inserted into the holster. To remove the firearm from the holster, the user grips the firearm with a firm high grip causing a pistol mounted disengagement mechanism to move and come into contact with the ejection geometry located on the holster side latching mechanism described herein.

In one or more embodiments the device comprises a housing comprising one or more latching devices. The latching device may be rotatably affixed to the housing with a pivot location. The pivot location may be closer to the grip of the pistol, or the pivot location may be centrally located, or on the muzzle end of the latching device housing. Additionally, in lieu of a pivot, the latching device may comprise a vertical slot allowing the latching device to move reciprocally toward or away from the body of the pistol as it is retained within the holster.

The latch movement required to disengage the pistol from the holster latching mechanism is minimal and may be accomplished with movement or displacement of the latching mechanism of approximately 0.25 inches or less in one embodiment. A user carries out the latch disengagement movement by performing the same action of gripping of the pistol that used to retrieve the firearm from the holster.

An aspect of the present disclosure relates to a holster side interface latching device to interface with a pistol side of an onboard pistol-to-holster retention device that is affixed permanently, semi-permanently, or built into/onto a gun holster as an additional feature that allows the gun to be retained within the holster. The retention device comprises a latching mechanism housing comprising a latching interface that is mounted so as to be movable from an engaged first position to a disengaged second position within the housing which is mounted or otherwise located on or within the holster and interacts with a firearm mounted lever mechanism that allows the retention device latching mechanism to be expelled by a lever mechanism on a pistol when the pistol mounted lever mechanism is pressed, pulled, pushed, rotated, or otherwise moved from a first latched position to a second unlatched position.

In one or more embodiments, the latching mechanism and housing for the same is affixed on or within the holster with mechanical fasteners, interface geometry such as dovetails, channels, keyways, or other semi-permanent methods.

In one or more embodiments, the latching mechanism is built in to the design of the holster and is located in a natural latching location such as adjacent to the trigger guard area, or other location found in a graspable area of the firearm mounted trigger mechanism built into or affixed to the gun.

The latching device mechanism comprises a latching interface which is mounted within the mechanism and pivots on an axle pin, roll pin, screw, bolt, or similar hardware. The latching interface is biased by use of a spring, or flexure, or the like causing the latching mechanism to be automatically returned to the first (latched) position when force from a lever mechanism located on the gun is not present, and allowing the latching interface to be moved to a second (unlatched) position when force is applied by a lever mechanism located on the gun.

An aspect of the present disclosure relates to a purpose driven gun to holster retention device that is affixed permanently, semi-permanently, or built into/onto a gun as an additional feature that allows the gun to retain itself within the holster. The retention device comprises a latching mechanism comprising a clasping or receiving device that accepts and retains a latching interface that is mounted on the holster and a trigger mechanism that allows the retention device to expel the latching interface when pressed, pulled, pushed, rotated, or otherwise moved to a release position.

In one or more embodiments, the release mechanism is affixed to the gun with adhesive, mechanical fasteners, interface geometry such as dovetails, channels, keyways, or other semi-permanent methods.

In one or more embodiments, the release mechanism is built in to the design of the gun and is located in a natural grasping location such as the trigger guard area, grip area, or other location found in a graspable area of the gun as it is drawn from the holster.

Another aspect of the present disclosure relates to a channel for receiving a holster mounted interface with a movable trigger mechanism located adjacent to it or within it that when triggered, expels the holster mounted interface allowing the gun to be readily removed.

Another embodiment of the device comprises a release mechanism with an aperture capable of receiving an insertion component comprising graspable geometry which is capable of mating, interfacing, or interlocking with a release mechanism affixed to the gun as described herein.

It should be noted that the same reference numerals are used in different figures for same or similar elements. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

Figure 6:
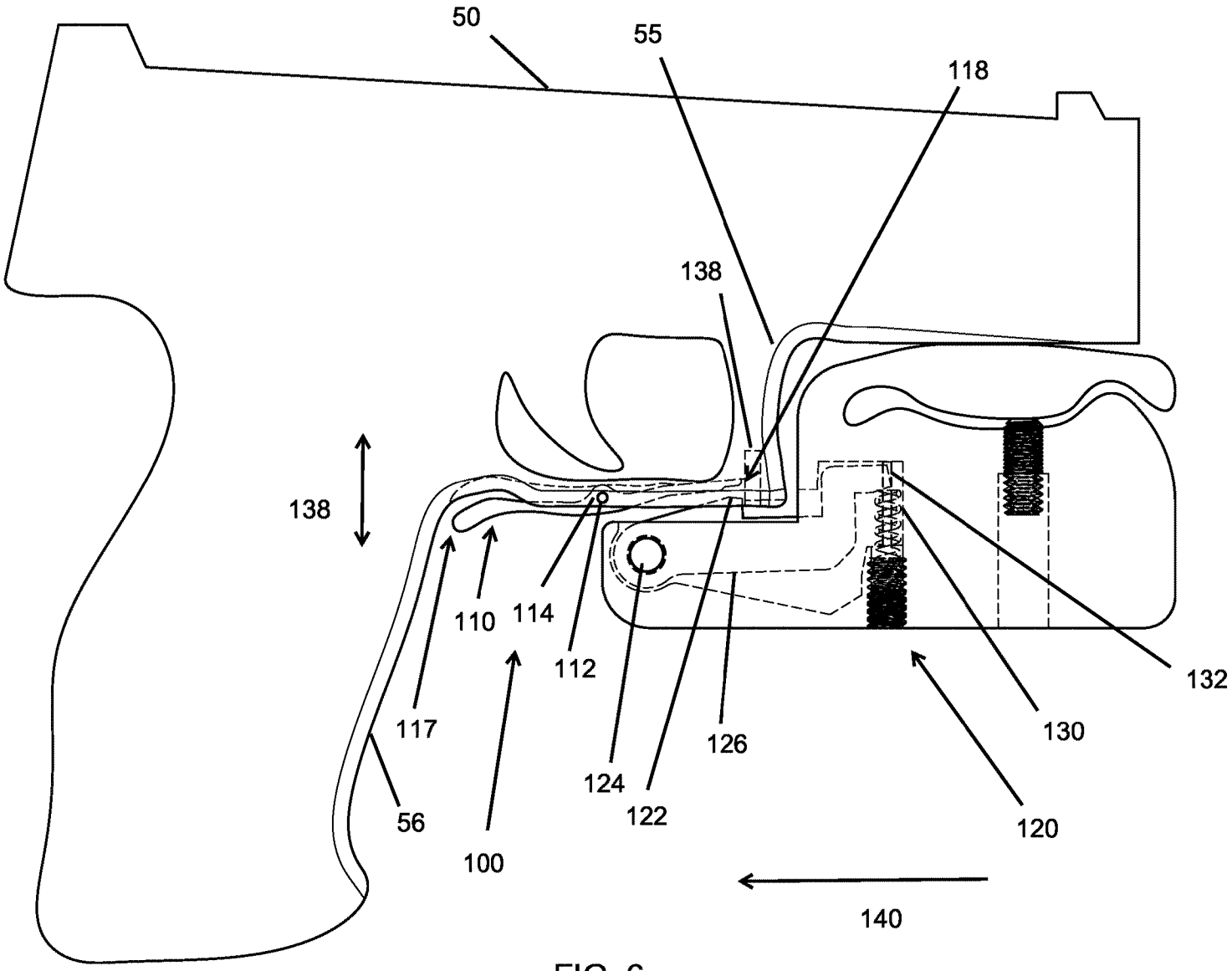
FIG. 6 is a side elevation view of a firearm retention device with both on-board and holster retention portions according to an embodiment of the present disclosure, in a firearm engaging position.
Figure 7:
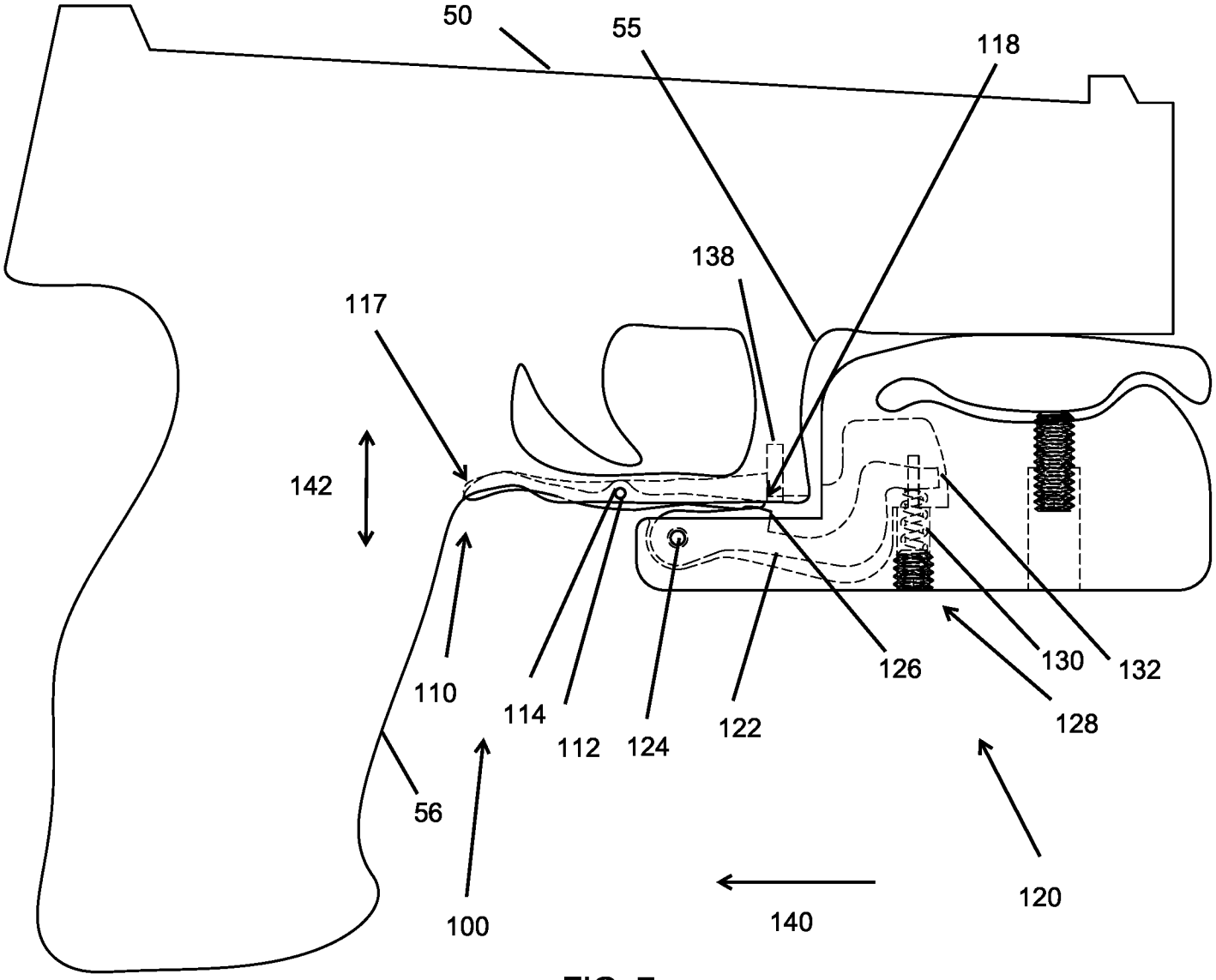
FIG. 7 is a side elevation view of the embodiment of FIG. 6 in a firearm releasing position.

Referring to FIGS. 6-7, a retention device 100 for a firearm such as firearm 50 is shown. Retention device 100 comprises in one embodiment a latching lever 110 mountable to a trigger guard 55 of the firearm 50, and a latching receiver 120 configured to receive and retain the firearm 50. In one embodiment, the latching lever 110 is mounted in the trigger guard 55 of the firearm 50 by a pin 112 to make the latching lever 110 pivotable about a first, or lever, pivot point 114. The latching lever pivots about first pivot point 114 on pin 112 between a first engaging position shown in FIG. 6 and a second release position as shown in FIG. 7.

The latching receiver 120 is configured in one embodiment to receive and retain the firearm 50. The latching receiver 120 comprises in one embodiment a latch 122 pivotable about a second, or latch, pivot point 124. The latch pivots about second pivot point 124 between a firearm engaging position as shown in FIG. 6 and a firearm release position as shown in FIG. 7. The latch 122 includes a protrusion 126 configured to engage and retain the firearm 50 when the latching lever 110 is in the first engaging position and the latch 122 is in the firearm engaging position. The latching receiver 120 includes a biasing component 128 that biases the latch 122 into the firearm engaging position. In one embodiment, this is accomplished by a spring 130 that engages a biasing arm 132. In normal configuration, the spring 130 is expanded and pushes biasing arm 132 upward (relative to FIG. 6), thereby pivoting latch 122 about pivot point 124 and moving protrusion 126 into engagement with a groove or detent 134 on the trigger guard 55 of the firearm 50. Latching receiver in one embodiment is configured to be mounted in a holster for forearm 50.

Both the latching lever and the latching receiver may comprise construction of metal, alloy, composite plastic, carbon fiber, or a combination thereof.

The latching lever 110 is mounted in the trigger guard 55 of a firearm 50 such that it places a first end 117 at or near where a frame of the firearm 50 meets a grip 56 of the firearm 50. A second opposite end 118 of the latching lever 110 forward of the pivot point 114 in proximity to the protrusion 126 of the latch 122. When a firearm is retained, with the latching lever 110 in the firearm engaging position as shown in FIG. 6, the end 117 of latching lever is forced downward and the end 118 is forced upward, by contact with the protrusion 126 engaging the trigger guard 55 via the biasing of latch 122 upward (e.g., counter-clockwise) about pivot point 124.

In the firearm retaining position as shown in FIG. 6, the protrusion 126 catches on a groove in the firearm 50 trigger guard 55 in one embodiment when the latching lever is in the first engaging position and the latch is in the firearm engaging position. The firearm 50 when engaged with the retention device 100 is secured into the retention device 100 by the protrusion 126 impeding removal of the firearm 50 in the direction shown by arrow 140. In this position, spring 130 is extended, and pushes up on a bottom of biasing arm 132, which also moves protrusion 126 upward to engage with the groove in the trigger guard 55 and retain the firearm 50 in the retention device. Latching lever 110 moves about first pivot point 114 according to the arrow 142.

Referring now to FIG. 7, when latching lever is pivoted in a clockwise motion about first pivot point 114, as shown by arrow 142, that motion moves end 117 upward about pivot point 114, and moves end 118 downward about pivot point 114. This movement of end 118 engages disengagement portion 116 of latching lever 110 with protrusion 126 when the firearm 50 is being retained in the retention device 100. The contact of disengagement portion 116 with protrusion 126 causes latch 122 to pivot in a clockwise manner about its second pivot point 124, moving protrusion 126 out of the groove in the trigger guard 55, allowing removal of the firearm 50 from the retention device 100 along the direction of arrow 140. This action compresses spring 130 through its contact with biasing arm 132. When the firearm 50 is removed from the retention device 100, the spring force of spring 130 on biasing arm 132 moves protrusion 126 up again, preparing it for a next firearm 50 to be inserted into and retained by the retention device 100.

Figure 9:
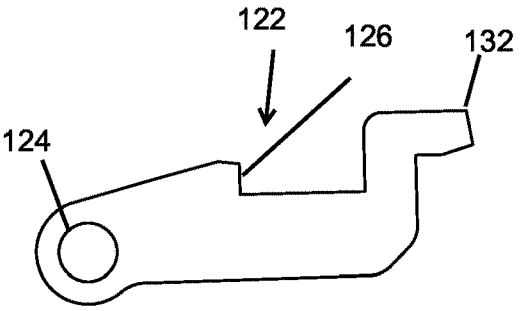
FIG. 9 is a side elevation view of a latch of a latching receiver according to an embodiment of the present disclosure.
Figure 8:
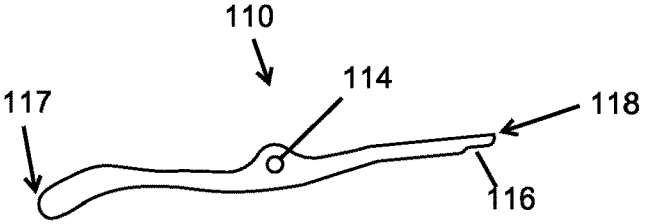
FIG. 8 is a side elevation view of a latching lever according to an embodiment of the present disclosure.
Figure 10:
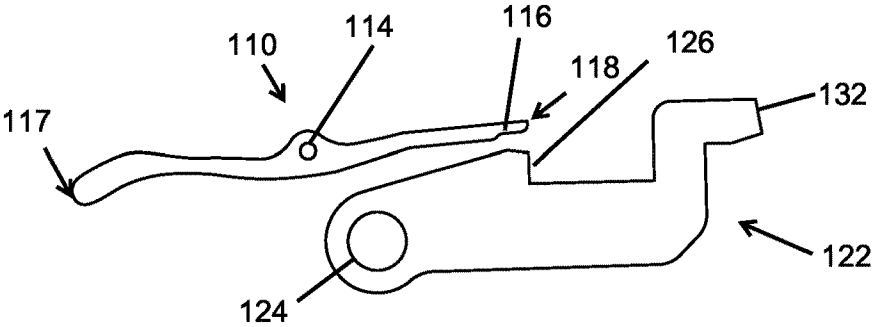
FIG. 10 is a side elevation view of a configuration of the latching lever of FIG. 8 and the latching receiver of FIG. 9 isolated from the retention mechanism.

Latching lever 110 is shown in greater detail in FIG. 8. Latch 122 is shown in greater detail in FIG. 9. The positional placement of latching lever 110 and latch 122 is shown in isolation in FIG. 10.

Figure 11A:
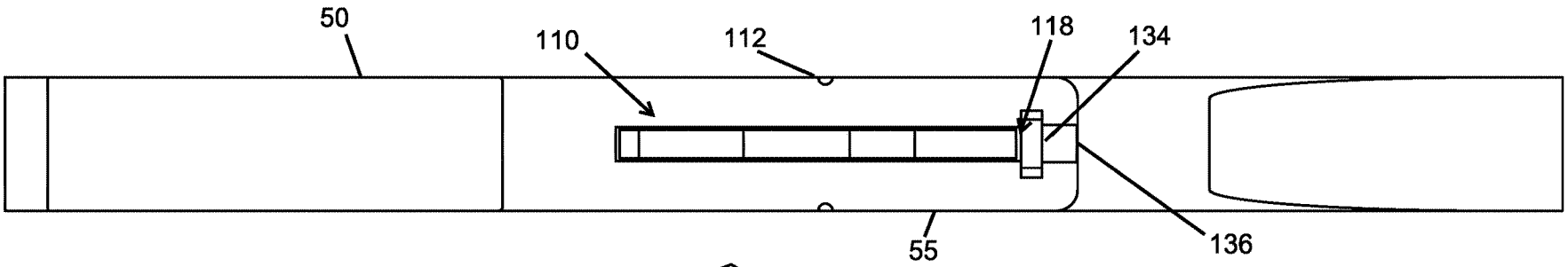
FIG. 11A is a bottom view of a firearm on which a latching lever is mounted in accordance with an embodiment of the present disclosure.
Figure 11B:
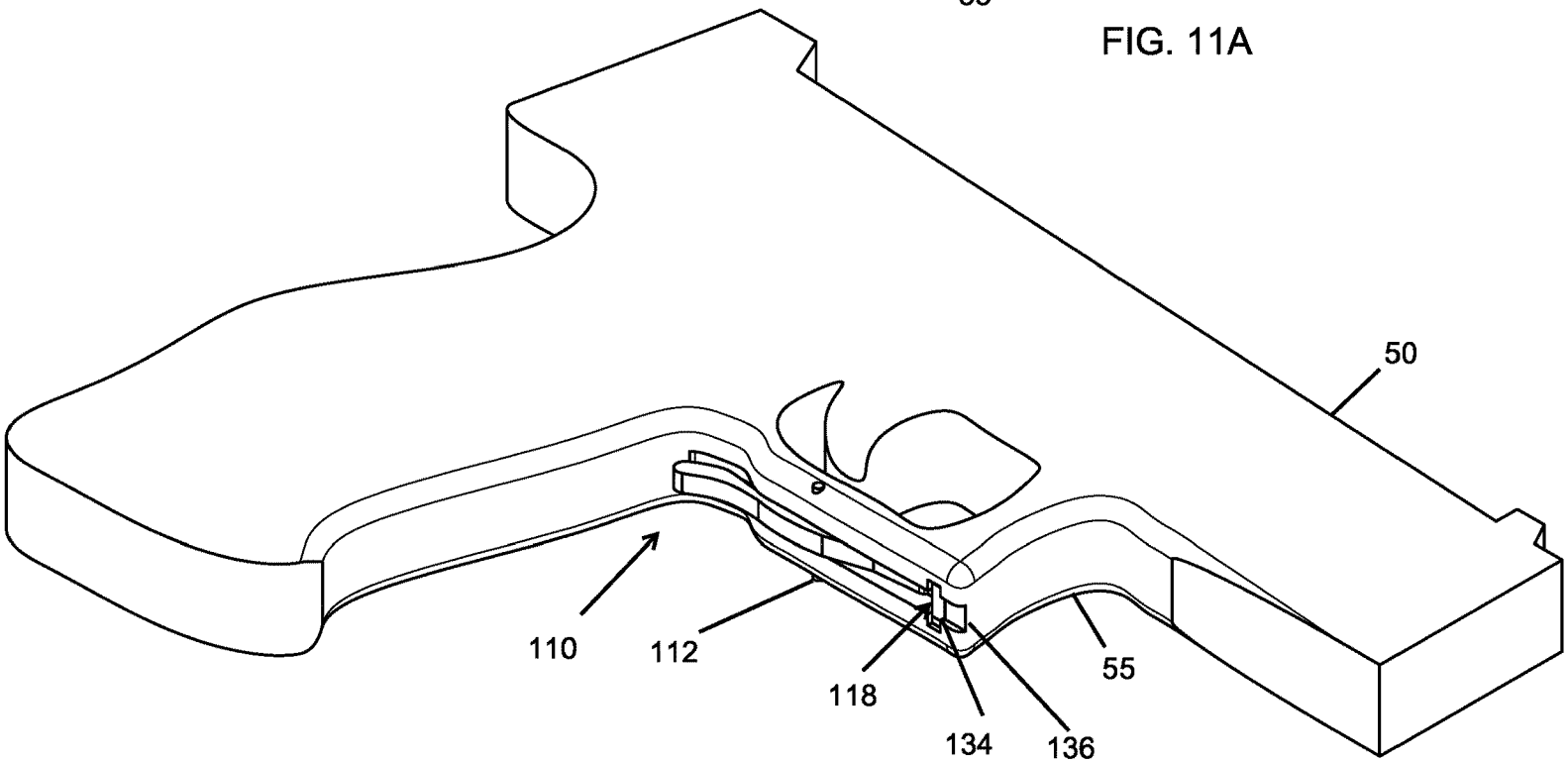
FIG. 11B is a perspective view of the embodiment of FIG. 11A.
Figure 12A:
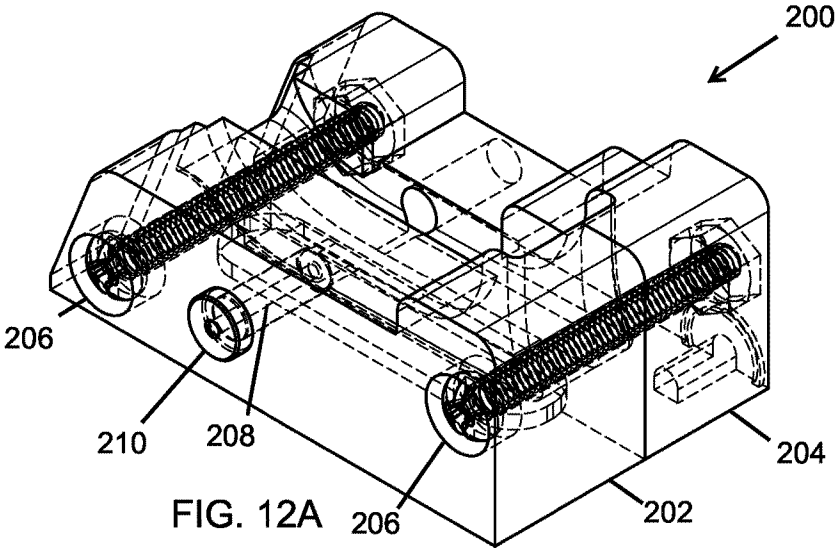
FIG. 12A is a perspective view of a jig according to an embodiment of the present disclosure.
Figure 12B:
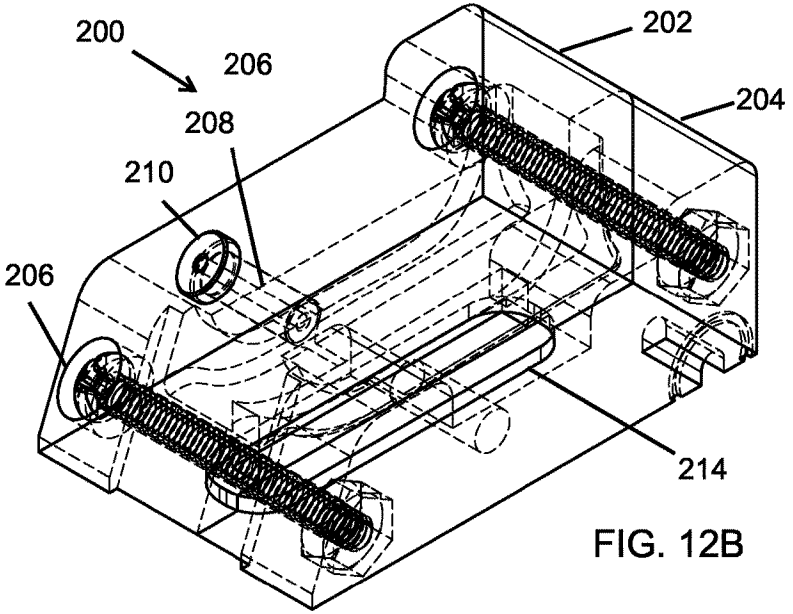
FIG. 12B is a perspective view from a different angle of the embodiment of FIG. 12A.
Figure 12C:
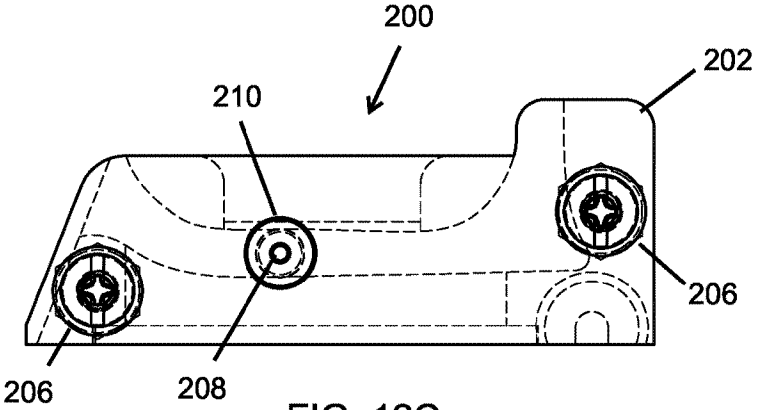
FIG. 12C is a side elevation view of the embodiment of FIG. 12A.
Figure 12D:
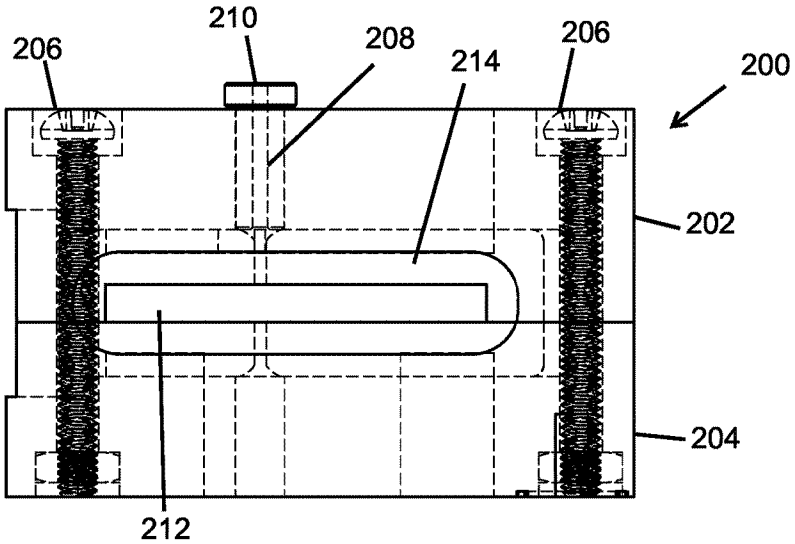
FIG. 12D is bottom elevation view of the embodiment of FIG. 12A.
Figure 13B:
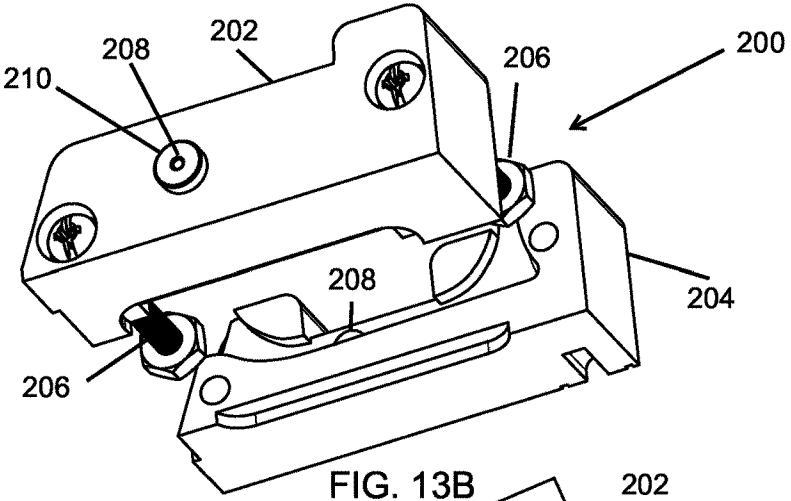
FIGS. 13A-13D are various perspective views of the jig portions of the jig of FIG. 12A in partially exploded view.
Figure 13D:
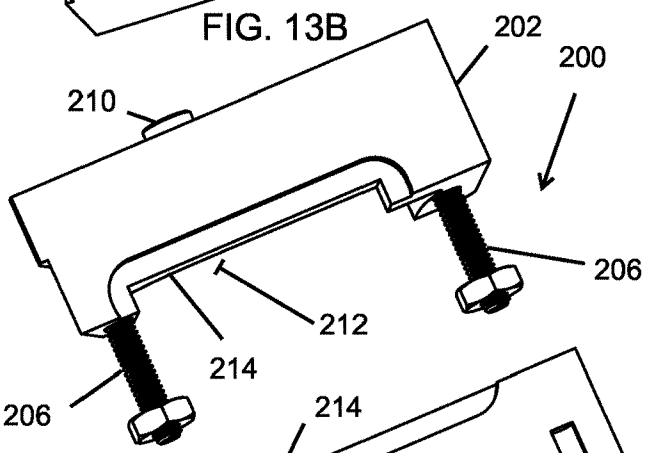
Figure 13D:
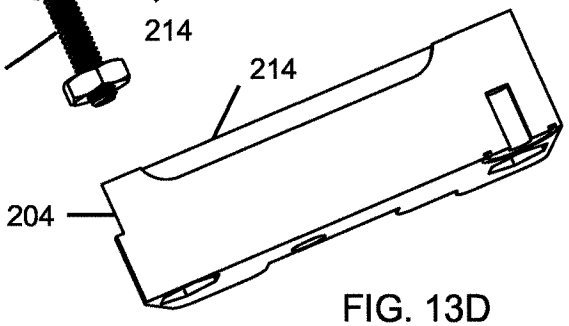
Figure 13C:
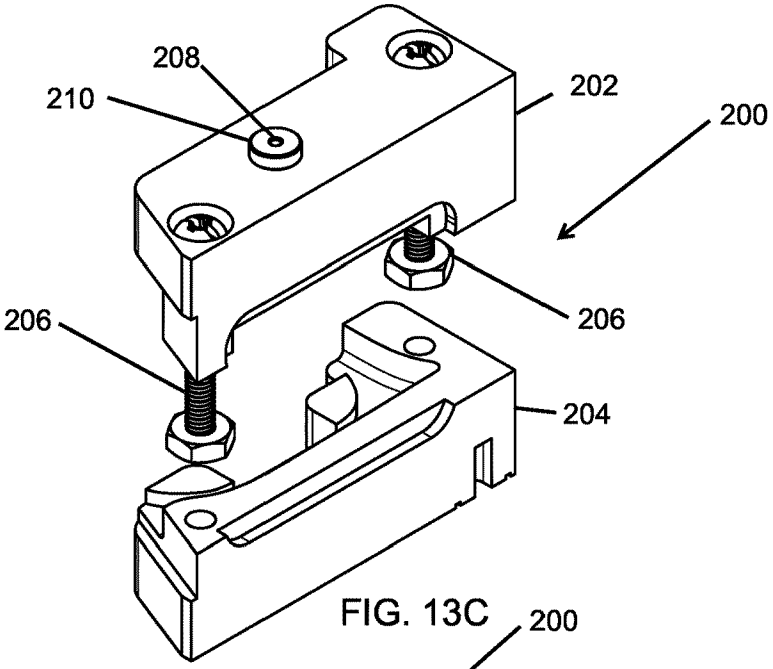
Figure 13A:
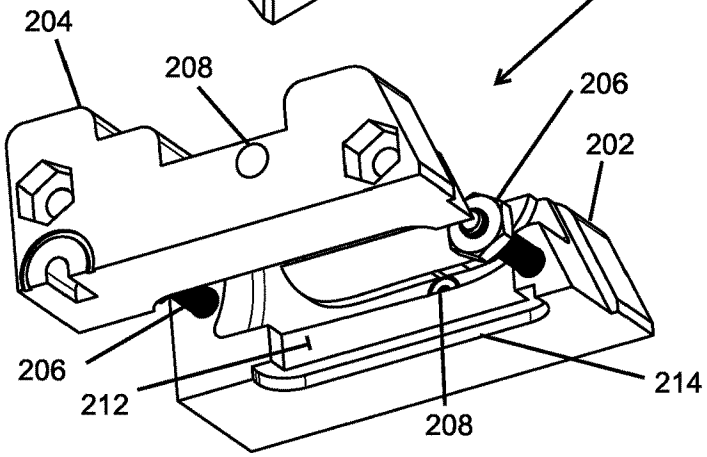
Figures 14A, 14B:
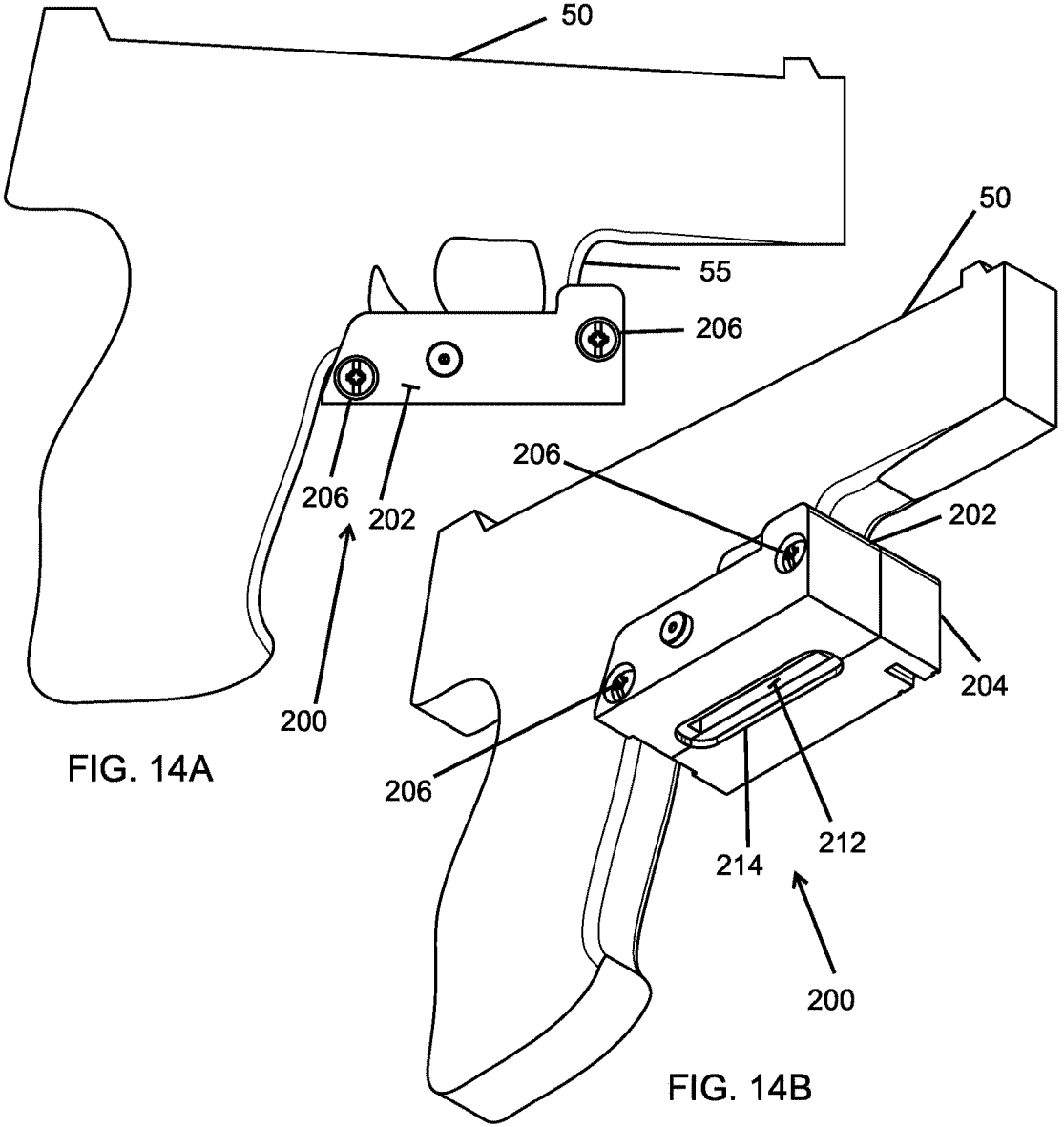
FIG. 14A is a side elevation view of the jig of FIG. 12A coupled to a firearm.
FIG. 14B is a perspective view of the embodiment of FIG. 14A.

A bottom view of a firearm 50 is shown in FIG. 11A and a perspective view is shown in FIG. 11B. In FIGS. 11A and 11B, a latching lever 110 is mounted in the trigger guard 55 of the firearm 50. In this configuration, groove 134 is present in the trigger guard 55. Further, pivot pin openings are present in the trigger guard 55 to accept pivot pin 112 therethrough to mount the latching lever 110 to the trigger guard 55. The groove 134 accommodates the latching lever 110 and has an end 136 that engages protrusion 126 when the latch 122 is moved to the firearm engaging position. The groove 134 may be made during manufacturing of the firearm, or may in another embodiment be machined or otherwise made in the trigger guard using a jig and method of modification discussed further below. Further, a wear block 138 may be positioned in the groove 134 at end 136 to provide protection against wear and tear of the trigger guard by the protrusion 126 of the retention mechanism 100. The wear block is shown in greater detail in FIGS. 6 and 7.

A jig 200 configured to modify a firearm such as firearm 50 to accommodate embodiments of the retention device 100 is shown in FIGS. 12A-12D, 13A-13D, and 14A-14B. Jig 200 in one embodiment is mounted on a trigger guard 55 of a firearm 50 to allow for the modification of the firearm 50 by providing a first jig portion 202 and a second jig portion 204 connected together over a trigger guard 55 with bolts 206. A drill opening 208 extends laterally through both portions 202 and 204 of jig 200. At one side, a drill guide 210 is mounted to assist in straight drilling through the drill opening 208. The drill opening aligns with a bottom portion of the trigger guide 55 when the jig is mounted to the trigger guard 55. The drill opening 208 extends through each of the first jig portion 202 and the second jig portion 204. The drill opening 208 is configured to engage trigger guard 55 at a lower portion thereof for drilling an opening in the lower portion from side to side of the trigger guard 55 when the jig 200 is secured on the trigger guard 55. This allows a user to drill an opening in the trigger guard for placement of the pin 112 to retain latching lever 110 therein as a retrofitted option.

Interior surfaces of the jig portions 202 and 204 are contoured in one embodiment to align with the trigger guard. When connected to each other with bolts 206 on trigger guard 55, the portions 202 and 204 define an opening 212 that exposes a portion of a bottom of the trigger guard 55 in the shape of the groove 134. A routing guide 214 surrounds the opening 212 to provide a guide for routing the groove 134 without placing a hole fully through the trigger guard 55. The opening 212 and routing guide 214 are best seen in FIGS. 12B, 12D, 13D, and 14B. In one embodiment, the opening 212 is sufficiently sized to provide a spot for placement of a wear block 138 as shown in FIGS. 6-7.

It should be understood that a firearm may be provided with the groove 134 and trigger guard opening from a manufacturer, and be covered with a plate or other plug, or may be provided with a full latching lever installation from the factory, without departing from the scope of the disclosure. The first jig portion 202 and the second jig portion 204 may comprise metal, alloy, composite plastic, carbon fiber, or a combination thereof.

Figure 15:
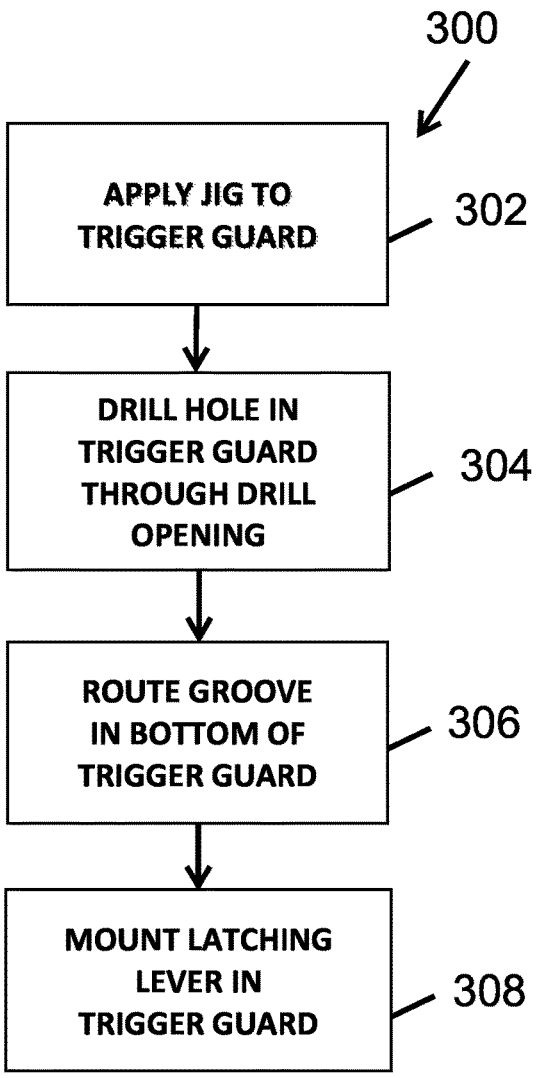
FIG. 15 is a flow chart diagram of a method according to an embodiment of the present disclosure.
Figure 17:
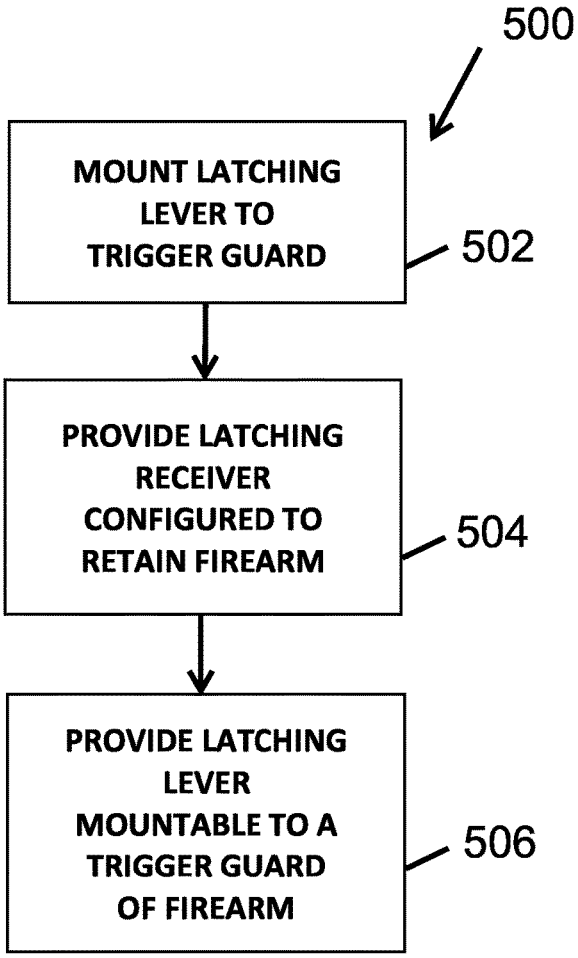
FIG. 17 is a flow chart diagram of a method according to yet another embodiment of the present disclosure.

FIG. 15 is a flow chart diagram of a method 300 for modifying a firearm trigger guard to add a retention device. Method 300 comprises, in one embodiment, applying a jig such as jig 200 to the trigger guard in block 302. The jig in one embodiment is the jig 200 described above, but it should be understood that other jigs may be used without departing from the scope of the disclosure, provided that they offer the ability to drill a hole side to side through the trigger guard, and route or otherwise form a groove such as groove 134 described above. The method 300 further comprises drilling a hole in the trigger guard through the drill opening in block 304, and routing a groove or slot in a bottom of the trigger guard at the groove opening in block 306. A latching lever is inserted into the trigger guard in block 308, in one embodiment by inserting a pin through the hole in the trigger guard and a hole in the latching lever. The latching lever is thereafter configured to be pivotable between a first engaging position and a second release position as described above. Additionally but optionally, a wear block may be mounted in one embodiment to the groove at a forward point of the groove to protect the trigger guard from wear.

Figure 16:
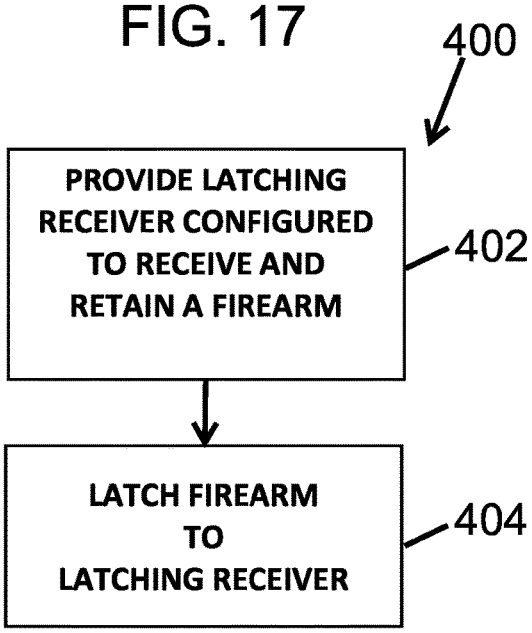
FIG. 16 is a flow chart diagram of a method according to another embodiment of the present disclosure.

FIG. 16 is a flow chart diagram of a method 400 for adding a retention device to a firearm. Method 400 comprises, in one embodiment, mounting a latching lever to a trigger guard of the firearm in block 402, and providing a latching receiver configured to receive and retain the firearm in block 404. The latching receiver may comprise a latch pivotable about a pivot point between a firearm engaging position and a firearm release position, the latch having a protrusion configured to engage and retain the trigger guard when the latching lever is in the first engaging position.

In one embodiment, mounting the latching lever to the trigger guard comprises drilling a hole in the trigger guard, routing a groove in a bottom of the trigger guard, and inserting the latching lever into the groove with a pin through the hole in the trigger guard and a hole in the latching lever as described above. In one embodiment, a wear block may be mounted to the groove at a point where the protrusion engages the trigger guard to protect the trigger guard from wear.

Additional subject matter that is supported by the above disclosure and may later be claimed includes at least the following:

A first set:

1. A firearm receiver, comprising:

a latching receiver configured to receive and retain the firearm, the latching receiver comprising a latch pivotable about a latch pivot point between a firearm engaging position and a firearm release position, the latch having a protrusion configured to engage and retain the firearm when the latching lever is in the first engaging position.

2. The firearm receiver of claim 1, wherein the latching receiver is biased toward the firearm engaging position by a spring.
3. The firearm receiver of claim 1, wherein the latching receiver is configured to engage a detent in a trigger guard of the firearm when in the firearm engaging position.
4. The firearm receiver of claim 1, wherein the latching receiver is mountable to a holster.
5. The firearm receiver of claim 1, and further comprising a firearm release mountable to the firearm, wherein the latching receiver is movable between the firearm engaging position and the firearm release position by the firearm release.
6. The firearm receiver of claim 5, wherein the firearm release comprises a lever movable about a lever pivot point between a first engaging position and a second release position.
7. The firearm receiver of claim 6, wherein the firearm release further comprises a block positioned on a trigger guard of the firearm to engage the protrusion at the trigger guard to prevent wear to the trigger guard.
8. The firearm receiver of claim 1, wherein the latching receiver comprises metal, alloy, composite plastic, carbon fiber, or a combination thereof.

A second set:

1. A jig for modifying a trigger guard of a firearm, comprising:

a first jig portion and a second jig portion configured to be joined together for encompassing at least a portion of the trigger guard;

a drill opening extending through each of the first jig portion and the second jig portion, the drill opening configured to engage the trigger guard at a lower portion thereof for drilling an opening in the lower portion from side to side of the trigger guard when the jig is secured on the trigger guard; and a groove opening at a bottom of the jig, configured to expose a portion of a bottom of the trigger guard for routing of the bottom of the trigger guard.

2. The jig of claim 1, wherein interior portions of the first jig portion and the second jig portion are shaped to align the jig with the trigger guard to properly expose the trigger guard for modification by drilling and routing.
3. The jig of claim 1, wherein the first jig portion and the second jig portion are joined together with bolts.
4. The jig of claim 1, wherein the first jig portion and the second jig portion comprise metal, alloy, composite plastic, carbon fiber, or a combination thereof.

A third set:

1. A method for modifying a firearm trigger guard to add a retention mechanism, comprising:

applying a jig to the trigger guard, the jig comprising:

a first jig portion and a second jig portion configured to be joined together for encompassing at least a portion of the trigger guard;

a drill opening extending through each of the first jig portion and the second jig portion, the drill opening configured to engage the trigger guard at a lower portion thereof for drilling an opening in the lower portion from side to side of the trigger guard when the jig is secured on the trigger guard; and a groove opening at a bottom of the jig, configured to expose a portion of a bottom of the trigger guard for routing of the bottom of the trigger guard;

drilling a hole in the trigger guard through the drill opening;

routing a slot in a bottom of the trigger guard at the groove opening; and inserting a latching lever into the trigger guard by inserting a pin through the hole in the trigger guard and a hole in the latching lever, the latching lever configured to be pivotable between a first engaging position and a second release position.

2. The method of claim 1, and further comprising mounting a wear block to the groove at a forward point of the groove to protect the trigger guard from wear.

A fourth set:

1. A retention device for a firearm, comprising:

a latching lever mountable in a groove in a trigger guard of the firearm, the latching lever pivotable about a first pivot point between a first engaging position and a second release position; and a pin coupling the latching lever to the trigger guard at the first pivot point.

2. The retention device of claim 1, and further comprising a wear block positioned at a front of the latching lever to engage a latching receiver to prevent wear to the trigger guard.
3. The retention device of claim 2, wherein the latching lever is rotatable from the first engaging position to the second release position by movement of the latching lever by a latching receiver from the first engaging position to the second release position.
4. The retention device of claim 1, wherein the latching lever comprises metal, alloy, composite plastic, carbon fiber, or a combination thereof.
5. The retention device of claim 1, wherein the latching lever is movable from the first engaging position to the second release position by pressure on an end of the latching lever located at a pistol grip end of the latching lever.

The embodiments of the present disclosure provide a retention device for a firearm that is mounted or provided in a trigger guard of a firearm. Additionally, a holster retention device cooperates with the firearm mounted retention device to secure a firearm in a holster. Methods for modifying a firearm to include a retention device, methods of adding the retention device, and a jig for modifying a firearm to accept a retention device are all provided.

The above-disclosed subject matter is to be considered illustrative, and not restrictive, and the appended claims are intended to cover all such modifications, enhancements, and other embodiments, which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A retention device for a firearm, comprising:

a latching lever mountable to a trigger guard of the firearm, the latching lever pivotable about a first pivot point between a first engaging position and a second release position; and a latching receiver configured to receive and retain the firearm, the latching receiver comprising a latch pivotable about a second pivot point between a firearm engaging position and a firearm release position, the latch having a protrusion configured to engage and retain the firearm when the latching lever is in the first engaging position.

2. The retention device of claim 1, wherein the latching receiver is biased toward the firearm engaging position by a spring.

3. The retention device of claim 1, wherein the firearm trigger guard is configured to support the latching lever with a pin therethrough.

4. The retention device of claim 1, wherein the protrusion is configured to engage a detent in the trigger guard of the firearm when in the firearm engaging position.

5. The retention device of claim 4, wherein the latch is rotatable from the firearm engaging position to the firearm release position by movement of the latching lever from the first engaging position to the second release position.

6. The retention device of claim 4, wherein the detent in the trigger guard is a groove therein.

7. The retention device of claim 6, wherein the detent in the trigger guard includes a wear block where the detent contacts the trigger guard to prevent wear to the trigger guard.

8. The retention device of claim 1, and further comprising a wear block configured to mount in the trigger guard of the firearm to engage the protrusion of the latch when the latch is in the firearm engaging position.

9. The retention device of claim 1, wherein the latching receiver is mountable to a holster.

10. The retention device of claim 1, wherein the latching lever comprises metal, alloy, composite plastic, carbon fiber, or a combination thereof.

11. The retention device of claim 1, wherein the latching receiver comprises metal, alloy, composite plastic, carbon fiber, or a combination thereof.

12. The retention device of claim 1, wherein the latching lever is movable from the first engaging position to the second release position by pressure on an end of the latching lever located at a pistol grip end of the latching lever.

13. The retention device of claim 1, wherein the latching receiver is mounted in a holster, and wherein the latching receiver comprises an integral flexure device to provide stability and controlled placement to the firearm within the holster.

14. A method of securing a firearm to a receiver, comprising:

providing a latching lever mountable to a trigger guard of the firearm, the latching lever pivotable about a first pivot point between a first engaging position and a second release position;

providing a latching receiver configured to receive and retain the firearm, the latching receiver comprising a latch pivotable about a second pivot point between a firearm engaging position and a firearm release position, the latch having a protrusion configured to engage and retain the firearm when the latching lever is in the first engaging position; and latching the firearm to the latching receiver.

15. The method of claim 14, wherein latching the firearm to the latching receiver comprises engaging the latching receiver to the trigger guard by moving the latching receiver to the firearm engaging position and the latching lever to the first engaging position.

16. The method of claim 14, and further comprising unlatching the firearm from the latching receiver by moving the latching lever from the first engaging position to the second release position.

17. A method of adding a retention device to a firearm, comprising:

mounting a latching lever to a trigger guard of the firearm; and providing a latching receiver configured to receive and retain the firearm, the latching receiver comprising a latch pivotable about a latch pivot point between a firearm engaging position and a firearm release position, the latch having a protrusion configured to engage and retain the trigger guard when the latching lever is in the first engaging position.

18. The method of claim 17, wherein mounting the latching lever to the trigger guard comprises drilling a hole in the trigger guard, routing a groove in a bottom of the trigger guard, and inserting the latching lever into the groove with a pin through the hole in the trigger guard and a hole in the latching lever.

19. The method of claim 18, and further comprising mounting a wear block to the groove at a point where the protrusion engages the trigger guard to protect the trigger guard from wear.

* * * * *